US005873214A

United States Patent [19]

Moore et al.

[11] Patent Number: 5,873,214

[45] Date of Patent: Feb. 23, 1999

[54] METHOD AND APPARATUS FOR LOAD BUILDING AND STRETCH WRAPPING

[75] Inventors: Phil Moore, Mt. Washington, Ky.; Curtis Martin, Floyds Knobs, Ind.; Patrick R. Lancaster, III, Louisville, Ky.

[73] Assignee: Lantech, Inc., Louisville, Ky.

[21] Appl. No.: 751,016

[22] Filed: Nov. 15, 1996

[51] Int. Cl.[6] ..... B65B 53/00; B65B 13/04; B65B 35/50; B65B 35/56

[52] U.S. Cl. ..... 53/399; 53/441; 53/446; 53/447; 53/556; 53/540; 53/544; 53/588; 414/744.6; 414/744.7; 414/752; 414/792.9

[58] Field of Search ..... 53/399, 441, 446, 53/447, 540, 544, 556, 588; 414/792.9, 744.4, 744.6, 744.7, 750, 751, 752

[56] References Cited

U.S. PATENT DOCUMENTS

| | | | |
|---|---|---|---|
| 3,885,678 | 5/1975 | Borg et al. | 214/1 BB |
| 4,132,318 | 1/1979 | Wang et al. | 214/1 BB |
| 4,587,796 | 5/1986 | Haloila | 53/588 |
| 4,593,517 | 6/1986 | Mattila | 53/441 |
| 4,666,050 | 5/1987 | Krieger et al. | 212/211 |
| 4,934,123 | 6/1990 | Salzsauler | 53/399 |
| 4,938,008 | 7/1990 | Salzsauler | 53/556 |
| 4,993,209 | 2/1991 | Haloila | 53/399 |
| 4,995,224 | 2/1991 | Yourgalite et al. | 53/540 |
| 5,005,335 | 4/1991 | Yourgalite et al. | 53/399 |
| 5,046,303 | 9/1991 | Becicka et al. | 53/540 |
| 5,107,657 | 4/1992 | Diehl et al. | 53/141 |
| 5,240,139 | 8/1993 | Chirnomas | 221/2 |
| 5,311,725 | 5/1994 | Martin et al. | 53/556 |
| 5,315,809 | 5/1994 | Gordon et al. | 53/399 |
| 5,336,042 | 8/1994 | Winski et al. | 414/789.5 |
| 5,372,472 | 12/1994 | Winski et al. | 414/786 |
| 5,390,476 | 2/1995 | Morantz | 53/556 |
| 5,404,691 | 4/1995 | Scherer | 53/399 |
| 5,423,163 | 6/1995 | Wendt | 53/556 |
| 5,445,493 | 8/1995 | Yourgalite et al. | 414/791.6 |

*Primary Examiner*—Linda Johnson
*Attorney, Agent, or Firm*—Finnegan, Henderson, Farabow, Garrett & Dunner, L.L.P.

[57] ABSTRACT

A load portion is engaged in an infeed area and transported from the infeed area to a wrapping area with rotational, horizontal, and vertical carriers. Those carriers move the portion of the load horizontally along two horizontal degrees of freedom and one vertical degree of freedom by rotating a portion of the load about a vertical axis and translating the portion of the load along a generally linear horizontal direction and a generally linear vertical direction. The load is disengaged in the wrapping area and a stretch wrap packaging material dispenser is engaged and is transported to the wrapping area by the same rotational, horizontal, and vertical carriers to wrap the portion of the load with stretch wrap packaging material by using, once again, the same rotational, horizontal, and vertical carriers to rotate the dispenser around the load.

49 Claims, 8 Drawing Sheets

METHOD AND APPARATUS FOR LOAD BUILDING AND STRETCH WRAPPING

BACKGROUND OF THE INVENTION

1. Field of the Invention

The invention relates to load building and wrapping devices and more particularly to methods and apparatus for stretch wrapping a load.

2. Description of the Related Art

Various arrangements have been used to build a load and stretch wrap the load with a sheet of stretch wrap packaging material. Robots with grippers, positionable by independent drive motors in multiple degrees of freedom, have been used to stack products in layers in a wrapping area. In some of these arrangements, stretch wrapping devices have been located next to the load building area to rotate the load relative to the dispenser for stretch wrap packaging material.

While these devices effectively build and stretch wrap a load, it is desirable to reduce their cost, size, weight, and complexity.

SUMMARY OF THE INVENTION

The advantages and purposes of the invention will be set forth in part in the description that follows, and in part will be obvious from the description, or may be learned by practice of the invention. The advantages and purpose of the invention will be realized and attained by means of the elements and combinations particularly pointed out in the appended claims.

To achieve these advantages and in accordance with the purpose of the invention, as embodied and broadly described herein, the present invention includes an apparatus for building and wrapping a load by transporting portions of a load to a wrapping area and wrapping the loading the wrapping area, comprising a load holder for releasably holding a portion of the load; a dispenser for dispensing packaging material; a frame for supporting the load holder and packaging material dispenser; a drive for moving the frame and product holder to position a portion of the load along a first horizontal degree of freedom, and to move the packaging material dispenser around the load and wrap packaging material around the load.

According to another aspect of the invention, a method is provided for building and wrapping a load comprising transporting portions of a load to a wrapping area with a load holder carried on a movable frame; wrapping the load in the wrapping area by moving a packaging material dispenser around the load in the wrapping area with the same frame.

It is to be understood that both the foregoing general description and the following detailed description are exemplary and explanatory only and are not restrictive to the invention, as claimed.

BRIEF DESCRIPTION OF THE DRAWINGS

The accompanying drawings, which are incorporated in and constitute a part of the specification, illustrate embodiments of the invention and together with the description, serve to explain the principles of the invention.

DETAILED DESCRIPTION OF THE PREFERRED EMBODIMENTS

Reference will now be made in detail to the present preferred embodiments of the invention, and examples of which are illustrated in the accompanying drawings. Wherever possible, the same reference numbers will be used throughout the drawings to refer to the same or like parts.

According to the present invention, a method and apparatus is provided for building and wrapping a load. As shown in FIG. 1, there is provided a load building and wrapping apparatus 20.

Figure 3:
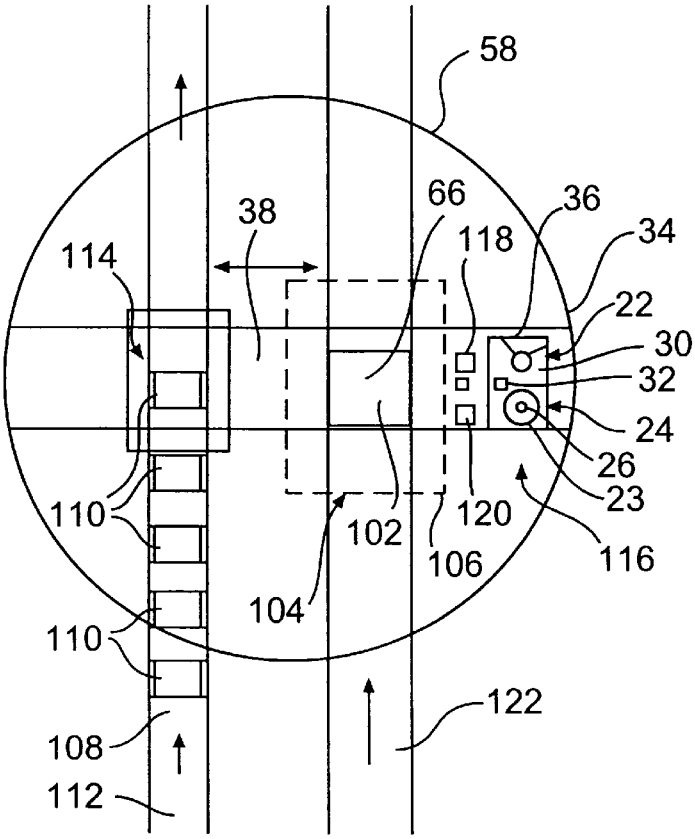
FIG. 3 is another partial top view of the apparatus shown in FIG. 1.

According to the present invention, a dispenser is provided for dispensing packaging material, such as stretch wrap packaging material or other packaging materials. As shown in FIG. 3, the dispenser for dispensing packaging material includes a stretch wrap packaging material dispenser 22 having a frame 24, a spindle 26 for supporting a roll 28 of stretch wrap packaging material, and a prestretch device 30, such as an upstream roller 32 and a downstream roller 34 which rotates faster than upstream roller 32, to stretch the sheet of stretch wrap packaging material 36 between upstream and downstream rollers 32 and 34. Various other rollers, sensors, and other arrangements may also be included.

Figure 1A:
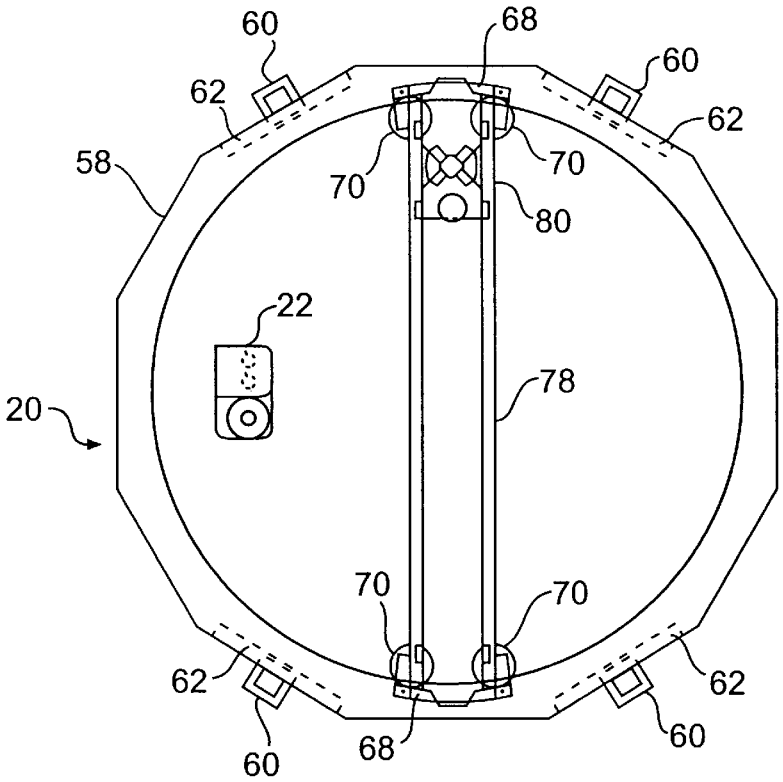
FIGS. 1A–1D are various perspective views of an apparatus for stretch wrapping a load incorporating the teachings of the present invention.
Figure 1B:
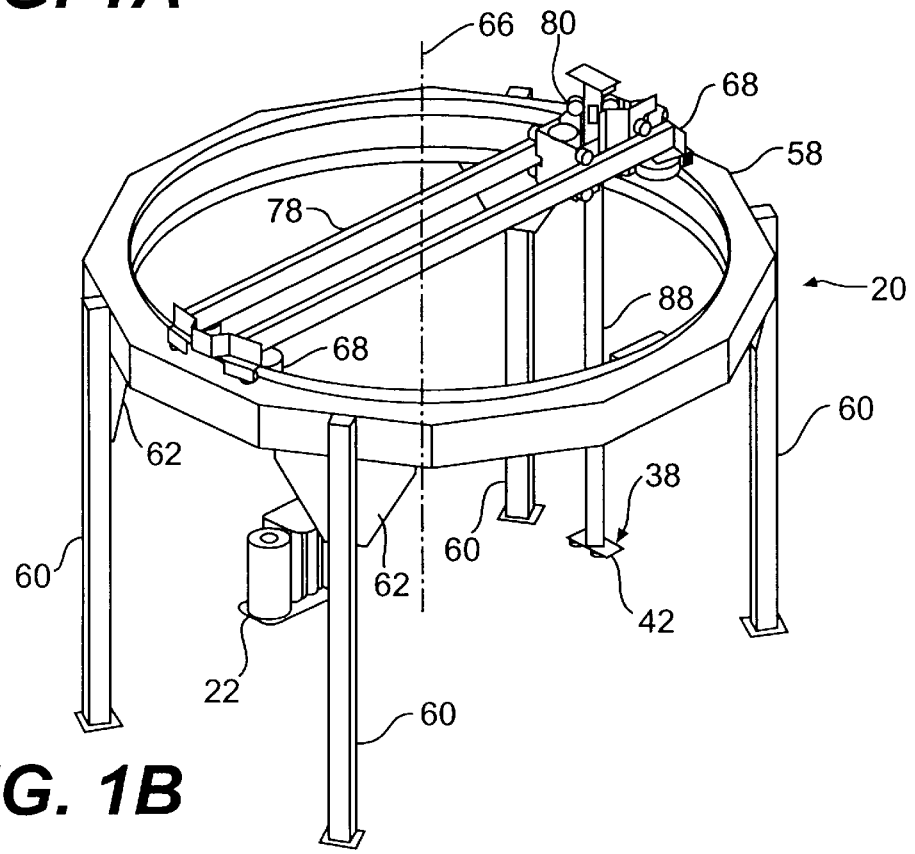
Figure 1C:
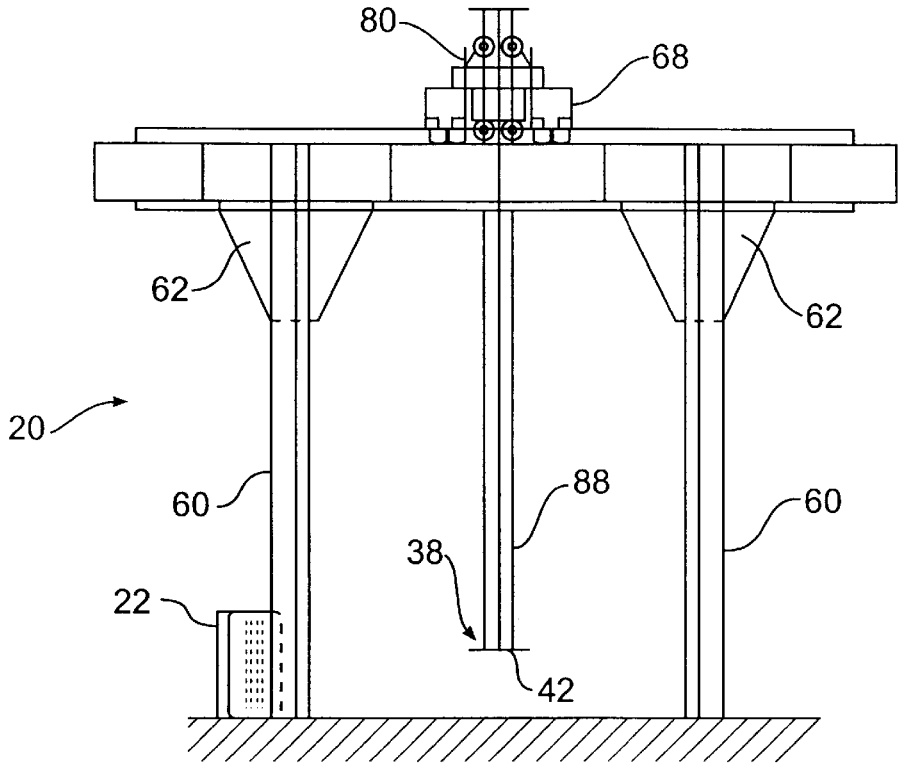
Figure 1D:
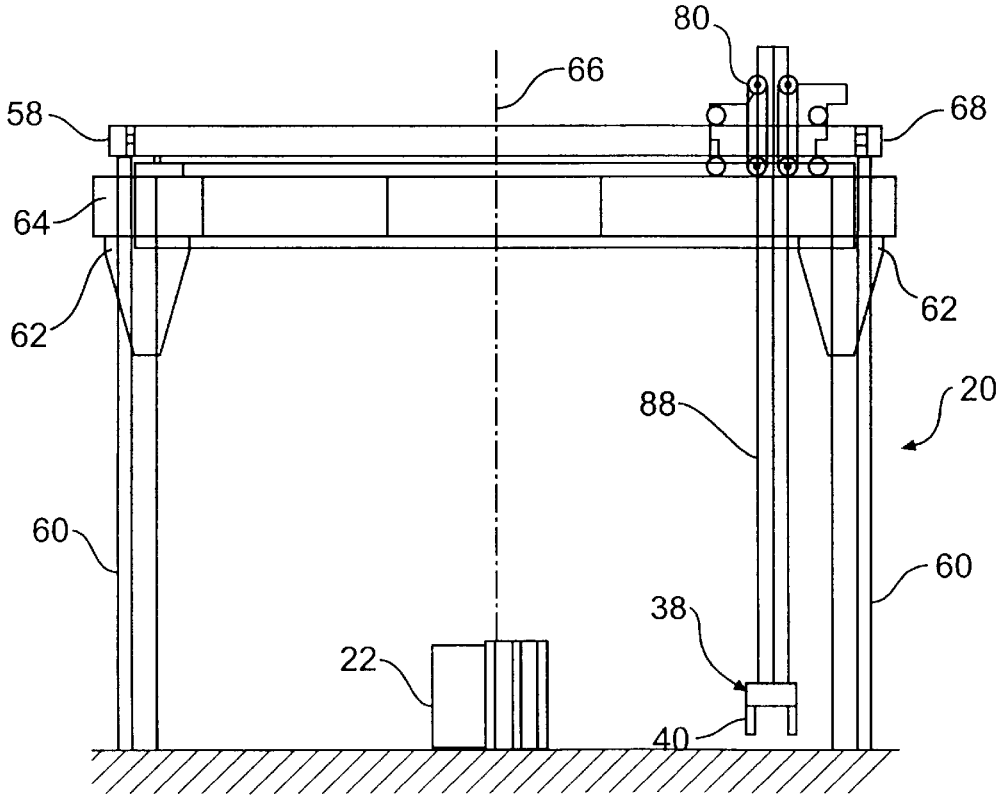
Figure 4:
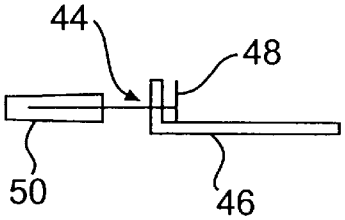
FIG. 4 is an alternative to a subassembly of the apparatus shown in FIG. 1.
Figure 5:
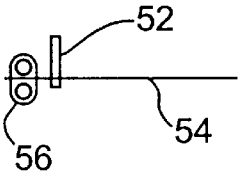
FIG. 5 is another alternative to a subassembly of the apparatus shown in FIG. 1.

According to the present invention, a product holder or engager is provided for releasably holding a portion of the load. As shown in FIG. 1, the load holder for releasably holding a portion of the load includes a gripper 38 having movable gripper fingers 40, as shown in FIG. 1D, or a suction device 42 such as a vacuum with suction cups, as shown in FIGS. 1B and 1C. Alternatively, the load holder includes a support for the bottom of the load and the dispenser 24. For example, as shown in FIG. 4, the support for the bottom of the load includes a slider bed 44, having a lower plate 46 for supporting the load and a pusher 48 driven by a hydraulic or pneumatic motor 50 to eject the portion of the load supported by the plate 46. Alternatively, as shown in FIG. 5, the slider plate may include a frame 52 with a slidable support plate 54 which can be withdrawn by a motor 56 to deposit the load.

Other means for releasably holding a portion of the load and the dispenser may also be employed. According to one aspect of the present invention, the same holding means engages both the portion of the load and the dispenser. As shown in the previously discussed embodiments, any of those holding means may be used to engage either a portion of the load or the dispenser. According to another aspect of the present invention, different holding means can be used to engage a portion of the load and the dispenser. For example, depending on the load and the dispenser and the type of support they need, different adapters can be used to engage the portion of the load and the dispenser.

According to the present invention, a drive is provided for moving the holding means rotationally about a vertical axis to position a portion of the load along a first horizontal degree of freedom and for rotating the dispensing means around the load to wrap stretch wrap packaging material around the load. As shown in FIG. 1, the drive for moving the holding means rotationally includes a ring support including ring 58 and its supports, such as legs 60, flanges 62 and lower ring 64, all of which fix ring 58 in a horizontal plane about a central vertical axis 66.

The drive for moving the holding means rotationally also includes a rotational carrier including roller support 68 having idler rollers 70 which rotationally mount roller support 68 to rotate around ring 58. The drive for moving the holding means rotationally also includes drive rollers 72 which engage a timing belt 74 disposed around the outside of ring 58 (see FIG. 2), and driving means such as a single or pair of motor and gear box arrangements 76 which power drive rollers 72.

The drive for moving the holding means rotationally is not limited to a ring support but can include other arrangements for moving the holding means rotationally, including a pivoting arm. In addition, even when using a ring support, the mechanisms can vary, including more or less roller supports, or supports positioned at different locations or driven differently.

According to the present invention, a drive is provided for moving the holding means horizontally along a second horizontal degree of freedom to position a portion of the load along a second horizontal degree of freedom. As shown in FIGS. 1A–1D and 2, the drive for moving the holding means horizontally includes a beam 78 positioned across the ring support 58 and connected to the rotational carrier, including roller support 68, to rotate preferably about central vertical axis 66. Beam 78 need not be limited to a single beam, a straight beam or a beam crossing the diameter of ring 58.

Figure 2:
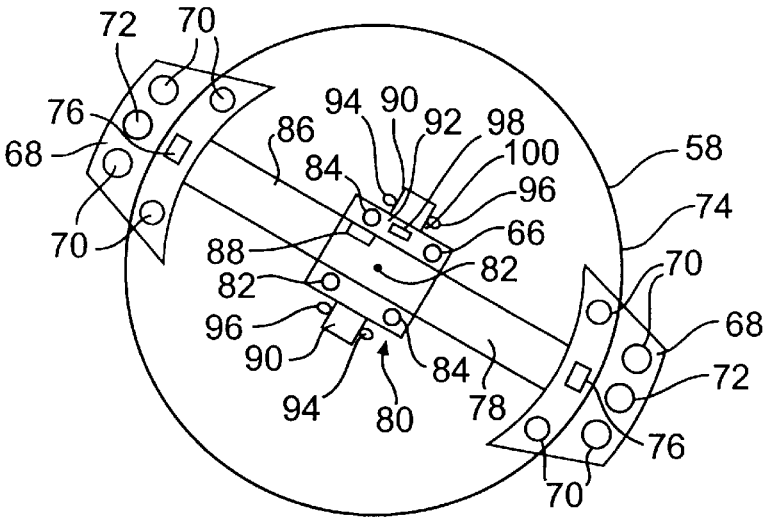
FIG. 2 is a partial top view of the apparatus shown in FIG. 1.

The drive for moving the holding means horizontally, as best shown in FIG. 2, also includes a radial carrier including roller support 80 mounted on beam 78 with a similar arrangement of idler rollers 82, drive rollers 84, timing belt 86, and motor and gear box 88 for powering drive roller 84 so that radial carrier 80 moves translationally in a generally linear horizontal direction along beam 78 in a radial direction from vertical axis 66.

The drive for moving the holding means horizontally may include arrangements other than a beam across the diameter of the path it follows, for example, another support system including beams in other positions or other carriers or drive mechanisms.

According to the present invention, a drive is provided for moving the holding means vertically to position the portion of the load along a third degree of freedom and move the dispensing means in a vertical direction to spirally wrap the load. As shown in FIGS. 1, and 6–10, the drive for moving the holding means vertically includes an arm 88 having two vertical poles 90 and a vertical carrier 92 including a roller support 80 having idler rollers 94 and drive rollers 96 powered by motor and gear box 98. Arm 88 is translationally movable in a generally linear vertical direction when drive rollers drive timing belt 100 on the surface of arm 88. The vertical carrier can take other forms as well. Alternatively, an elevatable load support or turntable can be used for vertical positioning.

As shown in FIGS. 1B–1D, gripper 38 is attached or attachable to the lower portion of arm 88 and therefore can be moved as described above preferably along two dimensions of horizontal freedom and one dimension of vertical freedom.

It is further preferable that the two dimensions of horizontal freedom include one rotational and one translational dimension of horizontal freedom. It is additionally preferable that the means for moving the holding means rotationally and horizontally include only two driving means and that the holding means is permitted to move along only two horizontal degrees of freedom in positioning the load and the dispensing means. This permits the resulting method and apparatus for load building and stretch wrapping to reduce the cost of construction and increase the simplicity of operation by using the same mounting arrangement with the same paths, the same degrees of freedom, and the same driving means to both build and wrap the load.

According to another aspect of the invention, for some applications, the two horizontal degrees of freedom may be rectilinear, rather than one rectilinear and one rotational, by constructing and mounting the frame for the holding means and dispenser to move in a Cartesian x-y coordinate system, rather than in a rotational or cylindrical coordinate system.

According to an aspect of the present invention, the means for moving the holding means horizontally along a second horizontal degree of freedom positions the dispensing means along the second horizontal degree of freedom while the means for moving the holding means rotationally is rotating the dispensing means around the load to rotate the dispensing means around the load in a non-circular path. The non-circular path is preferably shaped like the load. For example, when the load is rectangular, the non-circular path is preferably rectangular. In other words, the dispensing means is simultaneously rotated and moved in a second horizontal direction around the load in a path conforming to the shape of the load.

As shown in FIG. 3, load 102 is in the middle of wrapping area 104 and the gripper 38 engages the stretch wrap packaging material dispenser 22 and carries it around non-circular path 106 which is generally rectangular and generally shaped like the rectangular load 102. In some wrapping arrangements, moving dispenser 22 in such a path provides a desirable geometry and force characteristics on the film to provide a better wrapping of the load.

The control of the drive may include, for example, a programmable microprocessor or electromechanical control. The control sequences the drives and other components to perform the operations performed by the disclosed embodiments.

As shown in FIG. 3, the operation of the load building and stretch wrapping system may include an infeed conveyor 108 that conveys portions 110 of a load to be formed from an upstream end 112 of infeed conveyor 108 to an infeed area 114, which is in a different location than the assembled load area or wrapping area 104. The gripper 38 engages the load portion 110 in the infeed area 114 and transports it to the assembled load or wrapping area 104 by moving gripper 38 with the rotational carrier 68, radial carrier 80, and vertical carrier 92—lifting the load portion 110 vertically from the infeed area 114 with vertical carrier 92, transporting load portion 110 horizontally to the appropriate location in wrapping area 104 with rotational carrier 68 and radial carrier 80, depositing load portion 110 at the appropriate elevation using vertical carrier 92, disengaging load portion 110 from gripper 38 and returning gripper 38 in a similar fashion from the wrapping area 104 to the infeed area 114 where it may engage a new load portion 110.

Load portion 110 may in some instances be the complete load to be wrapped, a complete layer of the load to be wrapped, or one of several portions that form a layer of the load to be wrapped. The load can be wrapped in a number of different sequences, including after the whole load has been assembled or positioned in wrapping area 104, or after a layer or several layers less than a full load has been deposited in the wrapping area 104, so that the process alternates between building, wrapping, building, and wrapping a load.

After a complete or partial load is deposited in wrapping area 104 through the use of the rotational, radial, and vertical carriers 68, 80, and 92, those same carriers move gripper 38 to a position where it can engage stretch wrap packaging material dispenser 22, which has been sitting on the sidelines in dispenser storage area 116. When in that position, dispenser 22 is proximate to clamps 118, holding the leading end the sheet of stretch wrap packaging material 36, and a film cutting and wipe down device 120 for cutting and wiping down the trailing end of the sheet of stretch wrap packaging material on the load after the load has been wrapped.

Gripper 38 engages dispenser 22 with fingers 40, suction grips 42, or other arrangements, and transports the stretch wrap packaging material dispenser 22 around the load 102, by utilizing the same rotational, radial, and vertical carriers 68, 80, and 92 as used to transport the load portions.

The rotational carrier 68 may be used to rotate dispenser 22 around the load, radial carrier 80 may be used to position dispenser 22 radially from central axis 66 to form a rectangular path 106 if desired as discussed above, and vertical carrier 92 may be used to position dispenser 22 in the vertical direction, to allow load 102 to be spirally wrapped.

After wrapping either the whole load or a layer of the load, which can be a single unit or one or more rows or levels of product, gripper 38 may deposit and disengage dispenser 22 in dispenser storage area 116, using the rotational, radial and vertical carriers 68, 80, and 92, and continue building a load being wrapped or a new load, through, once again, the use of the same rotational, radial and vertical carriers used to transport gripper 38 between the dispenser storage area 116 and the wrapping area 104. An outfeed conveyer 122, as shown in FIG. 3, may be used to transport the wrapped load from the wrapping area 104, or, in some instances, gripper 38 may be used to do so by, once again, using rotational, radial and vertical carriers 68, 80, and 92 to engage and transport the load.

After the load has been wrapped, sheet 36 is once again gripped in clamps 118 in preparation for the next load to be wrapped and the film cutting and wipe down arrangement 120 is used in a conventional manner to cut and wipe down the sheet of stretch wrap packaging material on the load.

Figure 6:
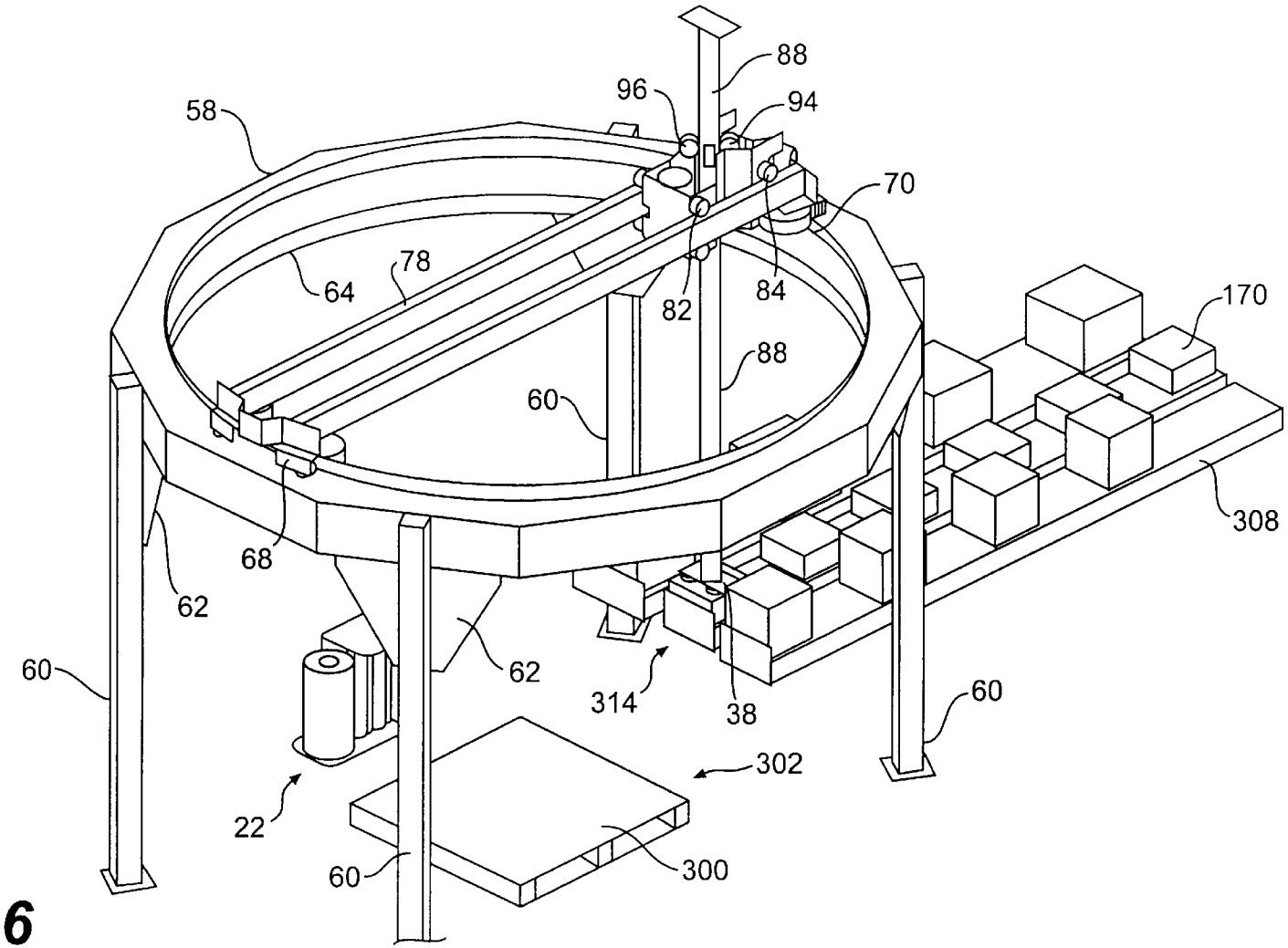
FIGS. 6–9 show a method of building and wrapping a load using an embodiment of an apparatus of the present invention.
Figure 7:
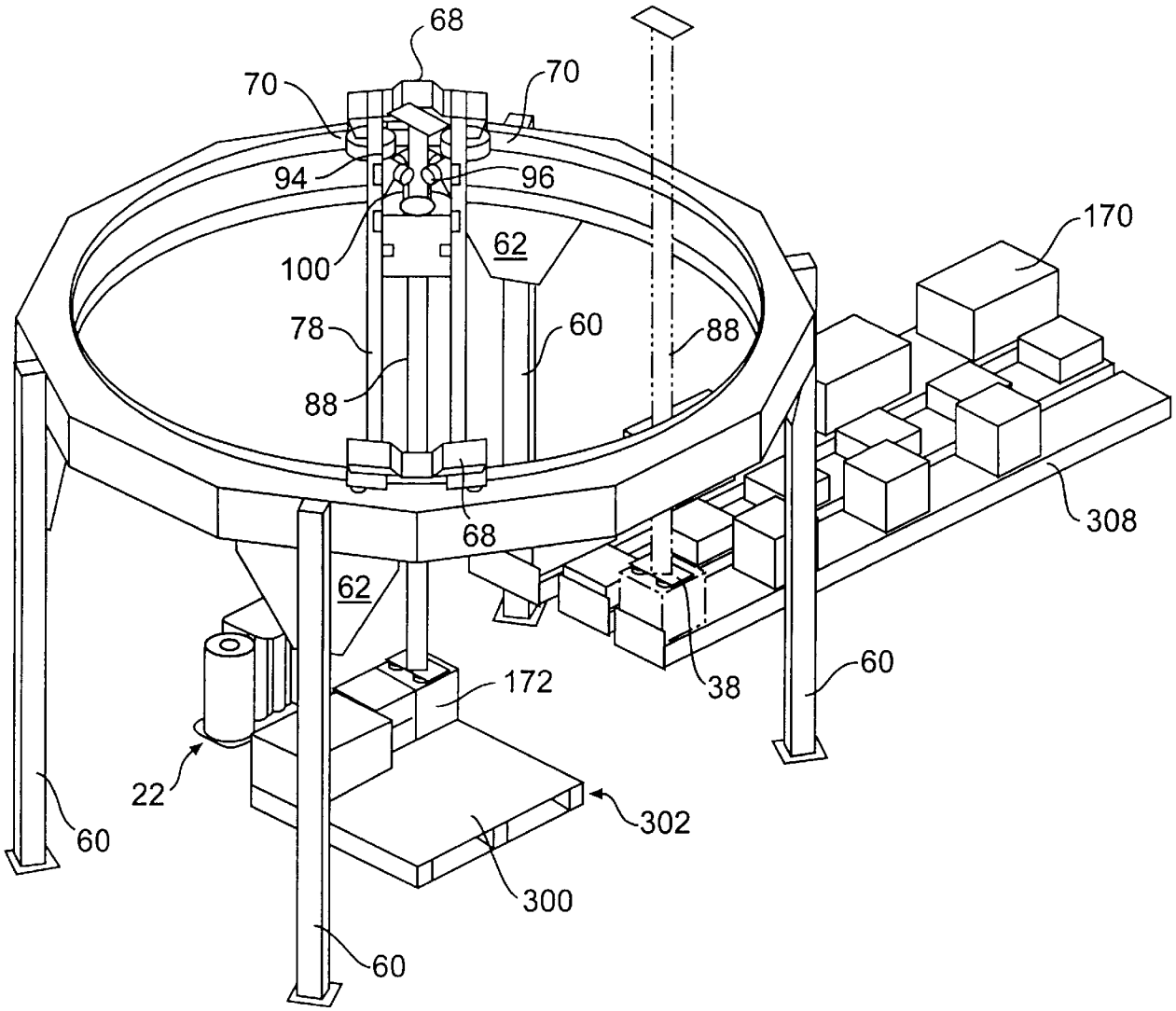
Figure 8:
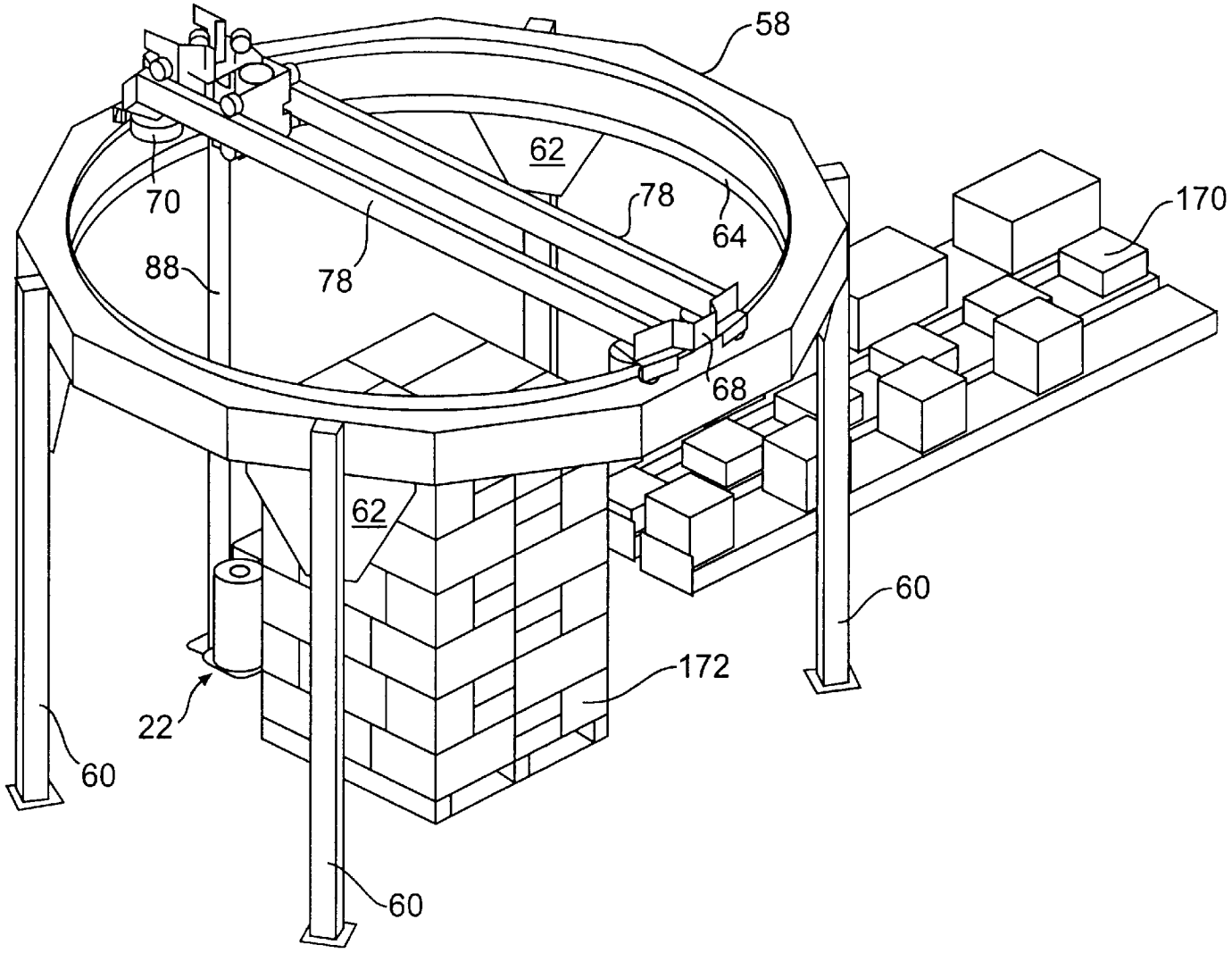
Figure 9:
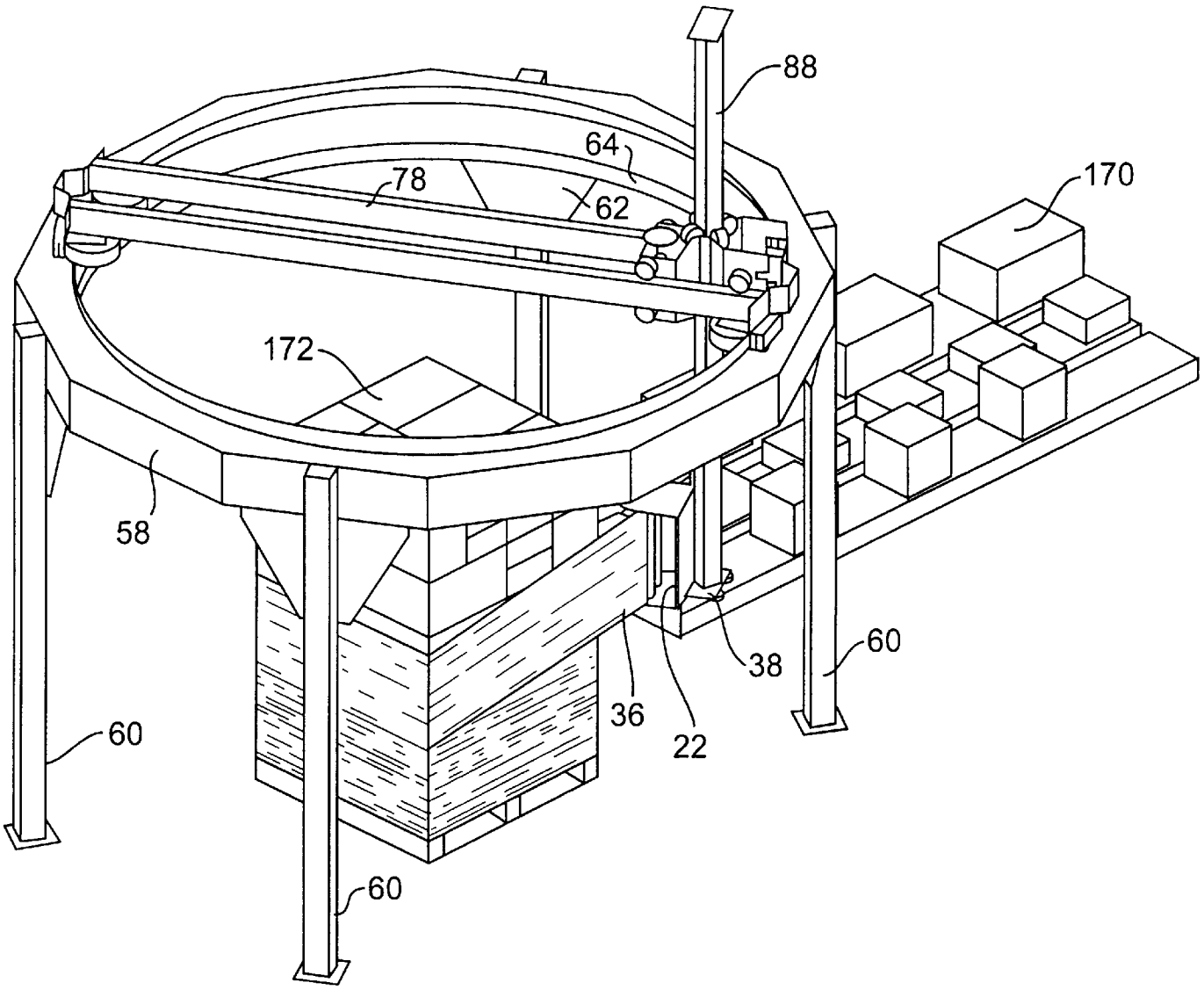

FIGS. 6–9 show the building of a load 172 from load portions 170 and the wrapping of load 172. In FIG. 6, an empty pallet 300 is placed within a wrapping area 302. Load portions 170 may be transported to an infeed area 314, which is in a different location than wrapping area 302, by an infeed conveyor 308. The gripper 38 engages a load portion 170 and moves it to the pallet 300. As seen in FIG. 7, this process is repeated again and again, gripper 38 engaging a load portion 170 and placing it upon pallet 300. While the load 172 is being built, packaging material dispenser is sitting to one side of load 172 being built. As seen in FIG. 8, once load 172 is built, arm 88 engages packaging material dispenser 22. As shown in FIG. 9, the packaging material dispenser 22 is then rotated around load 172 by arm 88 to wrap packaging material 36 around load 172. This is shown in FIG. 9.

Figure 10:
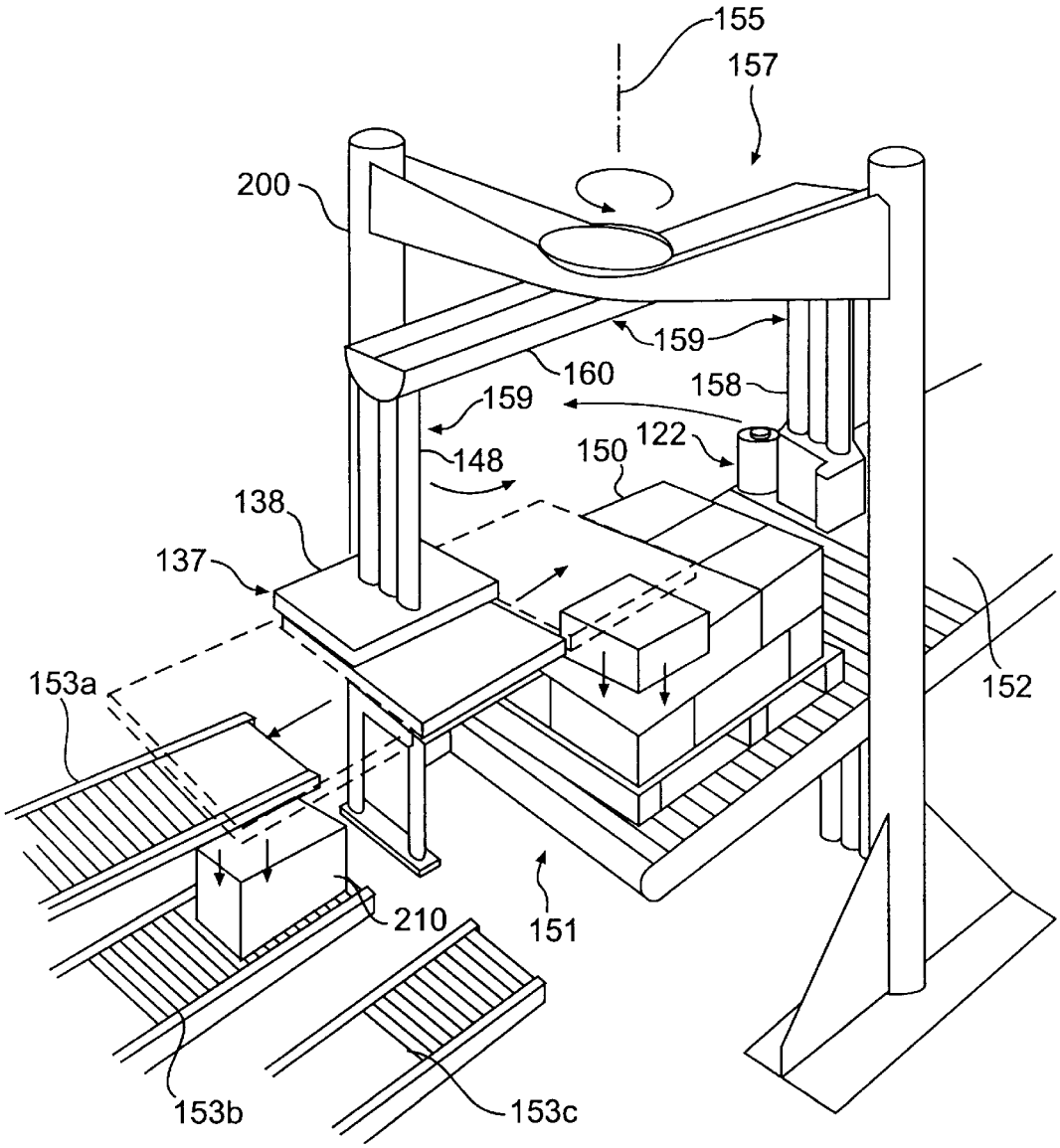
FIG. 10 is a partial perspective view of an alternative apparatus for stretch wrapping a load incorporating the teachings of the present invention.

FIG. 10 shows an alternative embodiment of a load building and wrapping device including a holder and engager for releasably holding a portion of the load and a packaging material dispenser. As seen, a single movable support frame 159 supports, positions, and moves both a load holder and engager 137 and a packaging material dispenser 122 when it is rotated by a single drive motor 157 about vertical axis 155. The load holder and engager 137 includes a gripper 138 having movable fingers, suction devices or a load support for engaging and moving a load portion 210 conveyed to the area by infeed conveyor 153. Gripper 138 is attached to a first support arm 148 of support frame 159 which depends from one end of beam 160 of support frame 159. Beam 160 may include, for example, a bar or series of bars.

Depending from the other end of beam 160 is a second support arm 158 which is attached to a film dispenser 122. Both first and second support arms 148, 158 may be movable and driven by motors along beam 160 to allow gripper 138 and dispenser 122 to move in a horizontal direction. The center of beam 160 is mounted to the center of cross member support 200 and rotates about this mounting.

In addition, first and second support arms 148, 158 are mounted to beam 160 to allow them to move and be driven by motors in a vertical direction relative to beam 160 to provide vertical movement of gripper 138 and film dispenser 122. Gripper 138 builds a load 150 in wrapping area 151 from load portions 210, and film dispenser 122 wraps load 150 in wrapping area 151. The load building gripper 138 may also be used to transport empty pallets or other packaging to the wrapping zone 151. The load 150 is then conveyed out of the wrapping zone 151 by outfeed conveyor 152.

Therefore, it is seen that the same rotational, radial, and vertical carrier may perform many functions including building a load, retrieving and engaging the stretch wrap packaging material dispenser, wrapping a load or load layer with the stretch wrap packaging material dispenser, transporting the stretch wrap packaging material dispenser to the dispenser storage area and disengaging the stretch wrap packaging material dispenser in the dispenser storage area, continuing to build the load or build a new load, and transporting the wrapped load from the wrapping area.

The invention provides a single unit which employs common movable structure, preferably in the form of the same movable frame and drives, to both build and wrap the load. Since the load can be wrapped by using one of the drives used in load building, only two horizontal drives and one vertical drive are required.

In addition, the load can be built in the wrapping area without needing to transport the built load to another location for wrapping. In other words, the stacking area is the same as the wrapping area.

The load building components such as the load holder may be used as well for purposes other than building and wrapping the load, such as moving pallets into the wrapping area, positioning labels, top and bottom caps, slip sheets, and corner boards on the load.

The frame can either permanently carry the packaging material dispenser and retain it during load building or releasably carry the packaging material dispenser, detaching it from the frame during load building and reattaching it during wrapping.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An apparatus for building and wrapping a load by transporting portions of a load to a wrapping area and wrapping the load in the wrapping area, comprising:

a product holder for releasably holding a portion of the load;

a dispenser for dispensing packaging material;

a frame for supporting the product holder and packaging material dispenser;

a rotational drive for moving the frame rotationally about a vertical axis to rotate the product holder about the vertical axis and position a portion of the load along a first horizontal degree of freedom, and to rotate the packaging material dispenser around the load and wrap packaging material around the load.

2. The apparatus of claim 1, including a second drive for moving the product holder horizontally and positioning a portion of the load along a second horizontal degree of freedom.

3. The apparatus of claim 2, including a third drive for moving the product holder vertically and positioning a portion of the load along a vertical degree of freedom.

4. The apparatus of claim 1, including a vertical drive for moving the product holder vertically and positioning a portion of the load along a vertical degree of freedom.

5. The apparatus of claim 1, including a vertical drive for moving the packaging material dispenser vertically and positioning the packaging material dispenser along a vertical degree of freedom.

6. The apparatus of claim 1, including a second drive for moving the product holder horizontally and moving the packaging material dispenser horizontally along a second horizontal degree of freedom.

7. The apparatus of claim 1, including a vertical drive for moving the product holder vertically and moving the packaging material dispenser vertically along a vertical degree of freedom.

8. The apparatus of claim 1, including a second drive for moving the product holder horizontally and moving the packaging material dispenser horizontally along a second horizontal degree of freedom and including a third drive for moving the product holder vertically and positioning a portion of the load along a vertical degree of freedom and for moving the packaging material dispenser vertically.

9. The apparatus of claim 1, wherein the frame releasably supports the packaging material dispenser.

10. The apparatus of claim 1, wherein the frame includes a first portion for supporting the product holder and a second portion for supporting the packaging material dispenser so that the product holder and packaging material dispenser at least partially counterbalance each other on the frame.

11. The apparatus of claim 1, including a second rotational drive for rotating the product holder about a vertical axis for angularly orienting a portion of the load relative to the frame.

12. The apparatus of claim 11, wherein the frame moves in a noncircular path which is generally rectangular.

13. The apparatus of claim 12, wherein the noncircular path is generally shaped like the load.

14. The apparatus of claim 2, wherein the second drive moves the product holder translationally in a generally linear direction.

15. The apparatus of claim 2, wherein the rotational drive includes a ring support and wherein the second drive includes a beam positioned across the ring support.

16. The apparatus of claim 15, wherein the ring support is stationary and the beam is driven to rotate about the ring support.

17. The apparatus of claim 3, wherein the third drive includes an arm translationally moveable in a generally linear vertical direction.

18. The apparatus of claim 1, wherein the product holder includes movable gripper fingers.

19. The apparatus of claim 1, wherein the product holder includes a suction device.

20. The apparatus of claim 1, wherein the product holder includes a support for the bottom of the load portion.

21. The apparatus of claim 1, wherein the product holder has a support for the bottom of the load including a slider bed.

22. The apparatus of claim 6, wherein the drives for moving the product holder and packaging material dispenser rotationally and horizontally include only two drives.

23. The apparatus of claim 1, wherein the frame is adapted to alternatively hold a portion of the load and the packaging material dispenser.

24. The apparatus of claim 1, wherein the frame is adapted to simultaneously hold a portion of the load and the packaging material dispenser.

25. The apparatus of claim 6, wherein the frame is adapted to permit movement along only two horizontal degrees of freedom in positioning the product holder and the dispensing means horizontally.

26. The apparatus of claim 1, wherein the frame includes a single portion that engages the portion of the load and the packaging material dispenser.

27. The apparatus of claim 6, including a mounting structure for permitting the product holder to move along only two paths in the horizontal direction.

28. The apparatus of claim 2, including a mounting structure for permitting the product holder to move along only two paths in the horizontal direction and wherein one path is rotational and the other path is translational.

29. The apparatus of claim 2, wherein the drives include a rotational carrier and a radial carrier.

30. The apparatus of claim 1, wherein the dispenser is a stretch wrap packaging material dispenser.

31. The apparatus of claim 1, wherein the frame and drive provide a common mounting structure and drive mechanism for permitting the product holder and packaging material dispenser to be carried and driven along the same path by the same mounting structure and drive mechanism.

32. A method for building and wrapping a load by transporting portions of a load to a wrapping area and wrapping the load in the wrapping area, comprising:

engaging a portion of a load in an infeed area with an engager;

transporting the engager with the portion of the load from the infeed area to the wrapping area by moving the engager and the portion of the load;

disengaging the portion of the load from the engager in the wrapping area;

wrapping the portion of the load with packaging material by rotating a packaging material dispenser around the load with the engager.

33. The method of claim 32, including moving the engager rotationally and radially to position the portion of the load.

34. The method of claim 32, including engaging the packaging material dispenser with the engager for wrapping the load, and subsequently, disengaging the packaging material dispenser from the engager.

35. The method of claim 32, including moving the engager vertically to vertically position the portion of the load and vertically position the dispenser to wrap the load.

36. The method of claim 32, including moving the engager and dispenser horizontally along both the rotational and translational degrees of freedom to rotate the dispenser around in a noncircular path.

37. The method of claim 36, wherein the noncircular path is generally rectangular.

38. The method of claim 36, wherein the noncircular path is generally shaped like the load.

39. The method of claim 32, including repeating the steps of engaging a portion of the load, transporting the engager, and disengaging the portion of the load; before performing the steps of engaging a stretch wrap packaging material dispenser and wrapping.

40. The method of claim 32, including alternatively performing the steps of engaging a portion of the load, transporting the engager, and disengaging the portion of the load to build a load layer; and performing the steps of engaging a stretch wrap packaging material dispenser and wrapping.

41. The method of claim 34, including engaging the portion of the load and the dispenser with the same engager.

42. The method of claim 34, including engaging the portion of the load and the dispenser with different engagers.

43. The method of claim 32, including using only two drives to move the engager to transport the portion of the load in the horizontal direction and rotate the dispenser around the load.

44. The method of claim 32, including repeating the steps of engaging a portion of the load, transporting the engager, and disengaging a portion of the load to build a load layer from several portions of the load, before performing the steps of engaging a packaging material dispenser and wrapping.

45. The method of claim 32, including repeating the steps of engaging a portion of the load, transporting the engager, and disengaging a portion of the load to build several load layers from several portions of the load, before performing the steps of engaging a stretch wrap packaging dispenser and wrapping.

46. A method for building and wrapping a load comprising:

transporting portions of a load to a wrapping area with a product holder carried on a movable portion of a frame;

wrapping the load in the wrapping area by rotating a packaging material dispenser around the load in the wrapping area with the same movable portion of the frame.

47. The method of claim 46, including rotationally driving the product holder and packaging material dispenser about a vertical axis with the same drive.

48. An apparatus for building and wrapping a load by transporting portions of the load to a wrapping area and wrapping the load in the wrapping area, comprising:

a product holder for releasably holding a portion of the load;

a dispenser for dispensing packaging material;

a frame including a moveable portion for supporting the product holder and packaging material dispenser;

a drive for moving the moveable portion of the frame and product holder to position a portion of the load along a first horizontal degree of freedom, and for moving the packaging material dispenser around the load to wrap packaging material around the load.

49. A method for building and wrapping a load by transporting portions of the load to a wrapping area and wrapping the load in the wrapping area comprising:

transporting portions of a load to a wrapping area with a product holder carried on a movable portion of a frame;

wrapping the load in the wrapping area by moving a packaging material dispenser around the load in the wrapping area with the same moveable portion of the frame.

* * * * *